US007938701B2

(12) United States Patent
Ito et al.

(10) Patent No.: US 7,938,701 B2
(45) Date of Patent: May 10, 2011

(54) WATERCRAFT INCLUDING PLURAL OUTBOARD MOTORS AND CONTROL THEREOF

(75) Inventors: Makoto Ito, Shizuoka-ken (JP); Takashi Yamada, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 472 days.

(21) Appl. No.: 11/694,519

(22) Filed: Mar. 30, 2007

(65) Prior Publication Data

US 2008/0026649 A1 Jan. 31, 2008

(30) Foreign Application Priority Data

Jul. 28, 2006 (JP) ..... 2006-206318

(51) Int. Cl.
*B63H 21/22* (2006.01)

(52) U.S. Cl. ..... 440/1; 440/85

(58) Field of Classification Search ..... 440/1, 84–87; 701/21; 123/179.1–179.3
See application file for complete search history.

(56) References Cited

U.S. PATENT DOCUMENTS

| | | | | |
|---|---|---|---|---|
| 4,836,809 | A * | 6/1989 | Pelligrino | 440/2 |
| 5,988,130 | A * | 11/1999 | Nakamura | 123/179.5 |
| 6,859,692 | B2 | 2/2005 | Okuyama | |
| 6,872,106 | B2 | 3/2005 | Kanno | |
| 6,878,019 | B2 | 4/2005 | Kanno et al. | |
| 6,910,927 | B2 | 6/2005 | Kanno | |
| 6,997,764 | B2 | 2/2006 | Okuyama et al. | |
| 7,096,097 | B2 | 8/2006 | Okuyama | |
| 7,108,570 | B2 | 9/2006 | Okuyama | |
| 7,142,955 | B1 * | 11/2006 | Kern et al. | 701/21 |
| 7,144,283 | B2 | 12/2006 | Kawase | |
| 2003/0060952 | A1 | 3/2003 | Kanno et al. | |
| 2003/0061076 | A1 | 3/2003 | Okuyama et al. | |
| 2003/0074114 | A1 | 4/2003 | Okuyama et al. | |
| 2004/0057450 | A1 | 3/2004 | Okuyama | |
| 2005/0286539 | A1 | 12/2005 | Okuyama | |
| 2005/0288833 | A1 | 12/2005 | Motose | |
| 2006/0089060 | A1 | 4/2006 | Kawase et al. | |

FOREIGN PATENT DOCUMENTS

| | | |
|---|---|---|
| JP | 2003-200895 | 7/2003 |
| JP | 2006-282171 | 10/2006 |

* cited by examiner

*Primary Examiner* — Ed Swinehart
(74) *Attorney, Agent, or Firm* — Keating & Bennett, LLP

(57) ABSTRACT

There is provided a watercraft in which a controlling state before a start-up changes less easily and an operating state of a remote controller and a remote controller lever for operating the watercraft propulsion unit is easily kept stable, although at least one of watercraft propulsion units has been in operation and other watercraft propulsion unit(s) starts-up. Remote controllers are connected to watercraft propulsion units. The remote controllers include controlling units, and remote controller levers corresponding to the watercraft propulsion units. The controlling units are mutually connected together to communicate with each other. When one of the watercraft propulsion units has been in operation and the other one start-up from a stop state, the controlling unit corresponding to the start-up watercraft propulsion unit recognizes a controlling state of the controlling unit in operation and controls to agree with the controlling state thereof.

11 Claims, 7 Drawing Sheets

[FIG. 1]
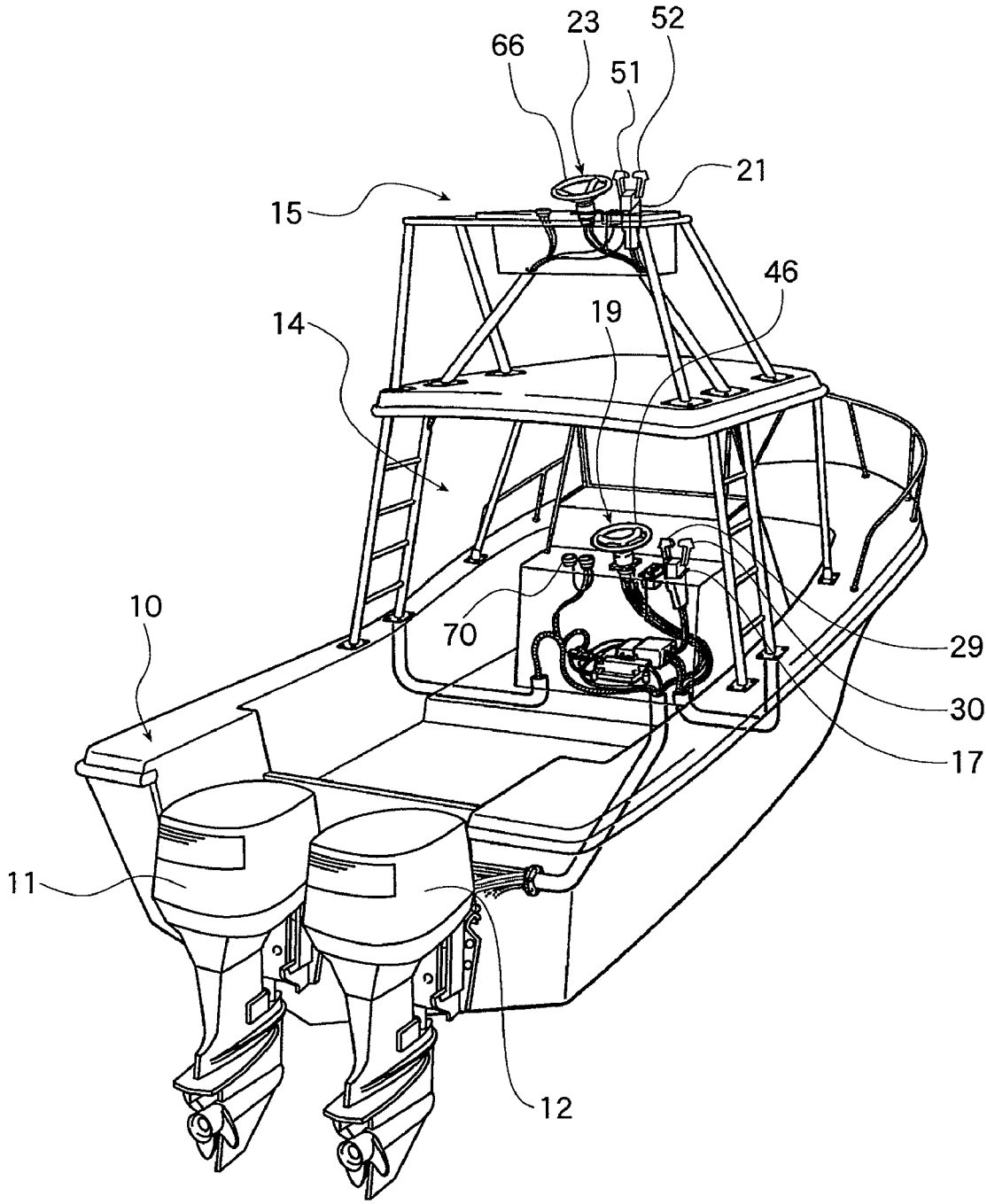

[FIG. 2]
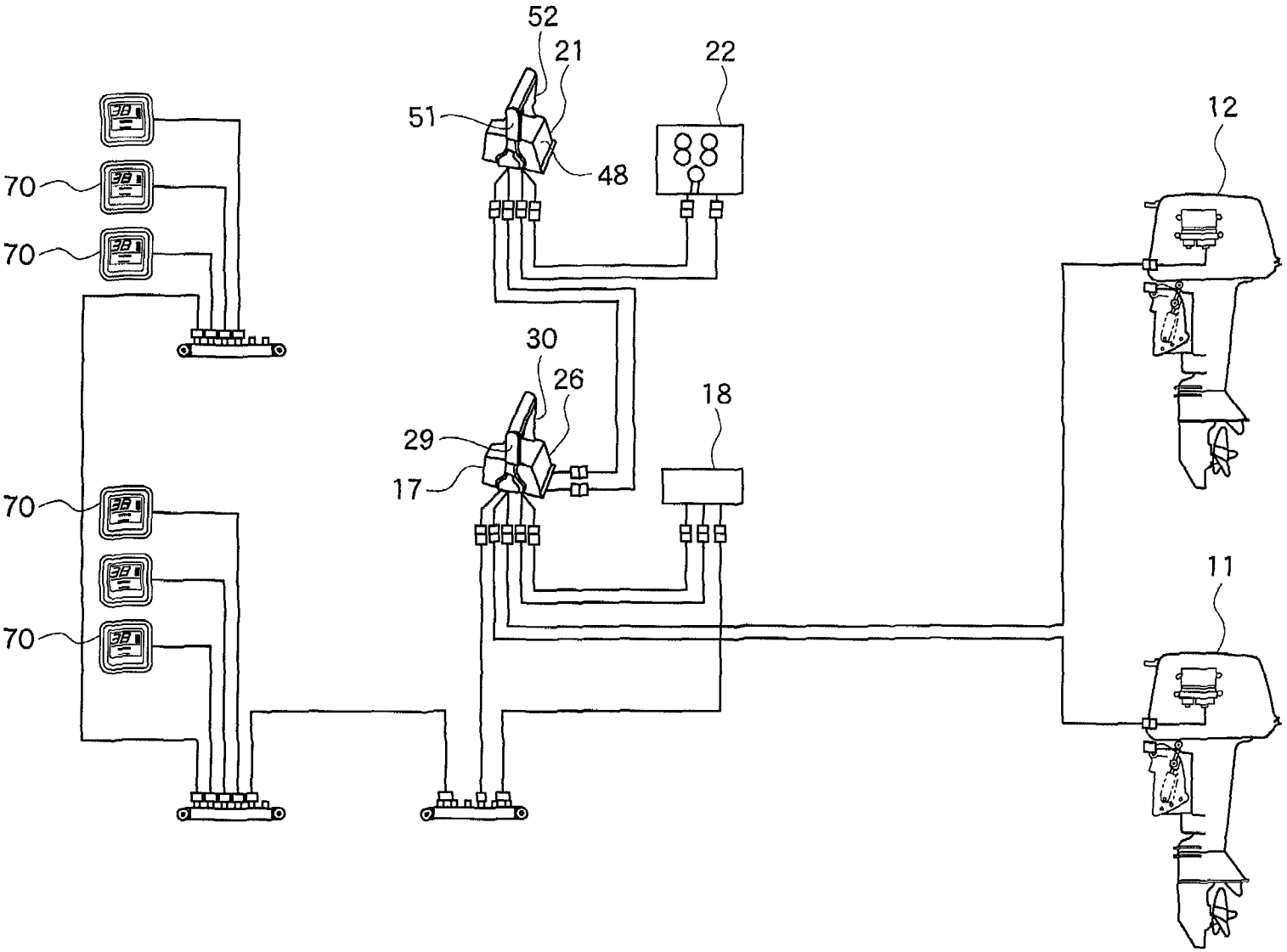

[FIG. 3]
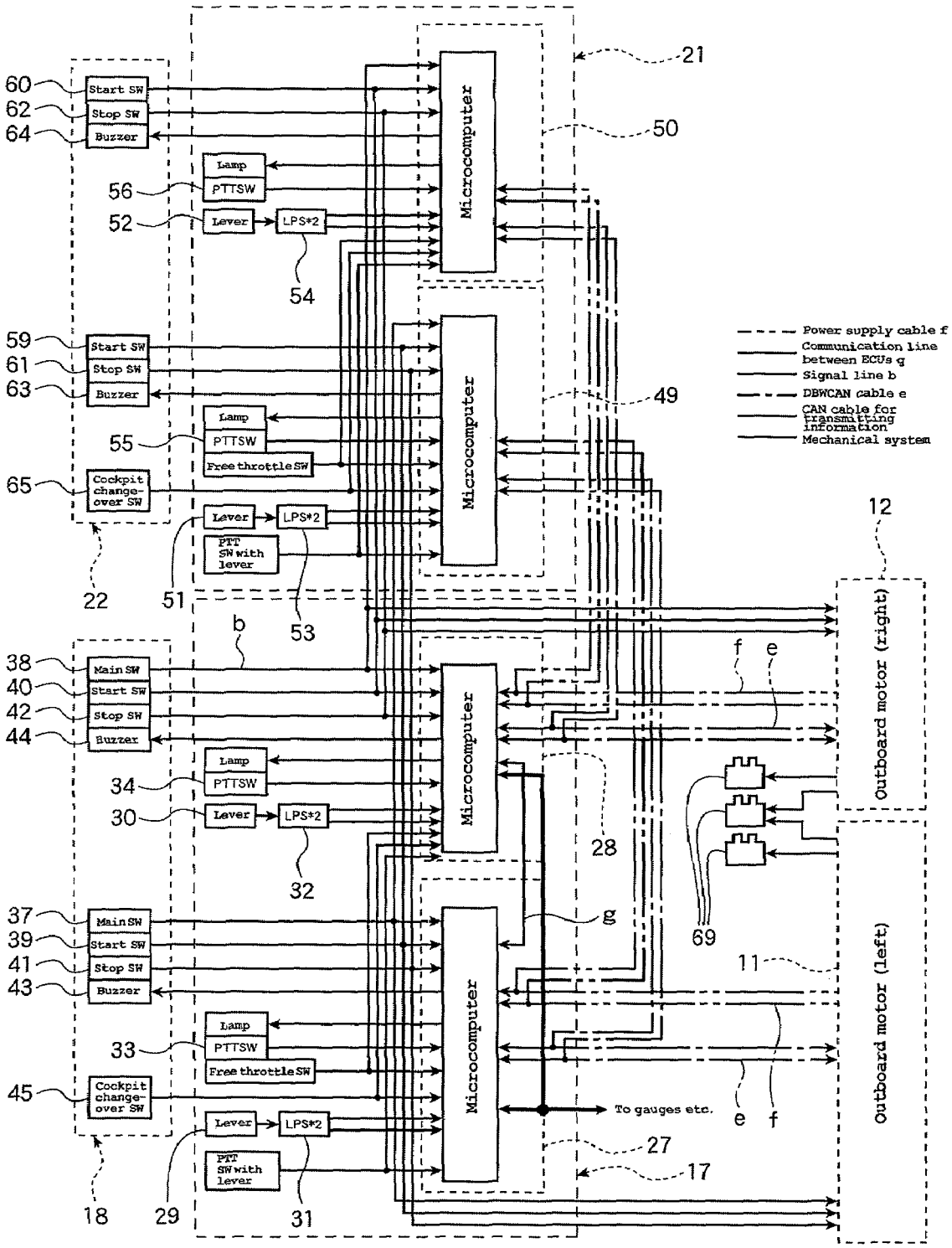

[FIG. 4]
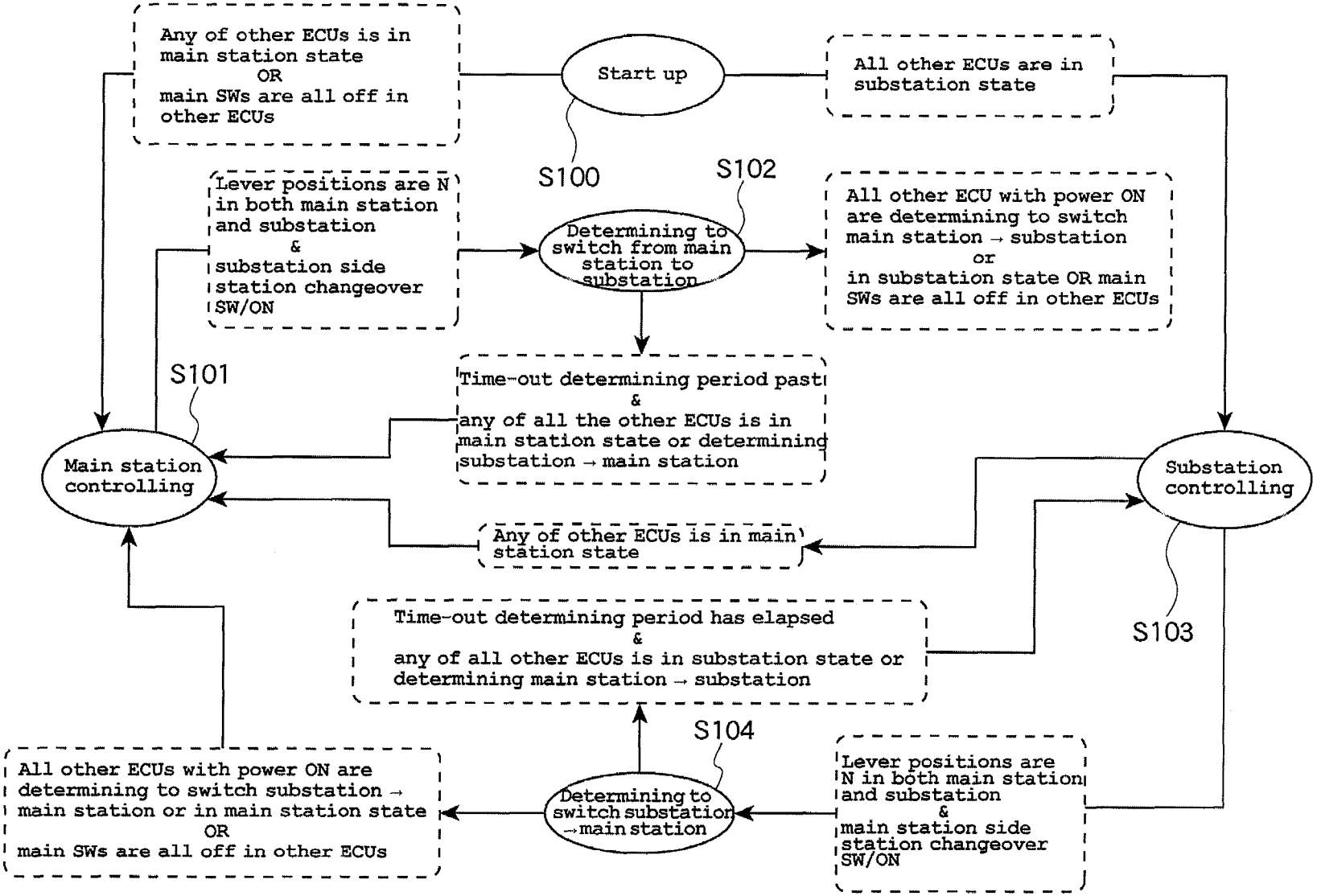

[FIG. 5]
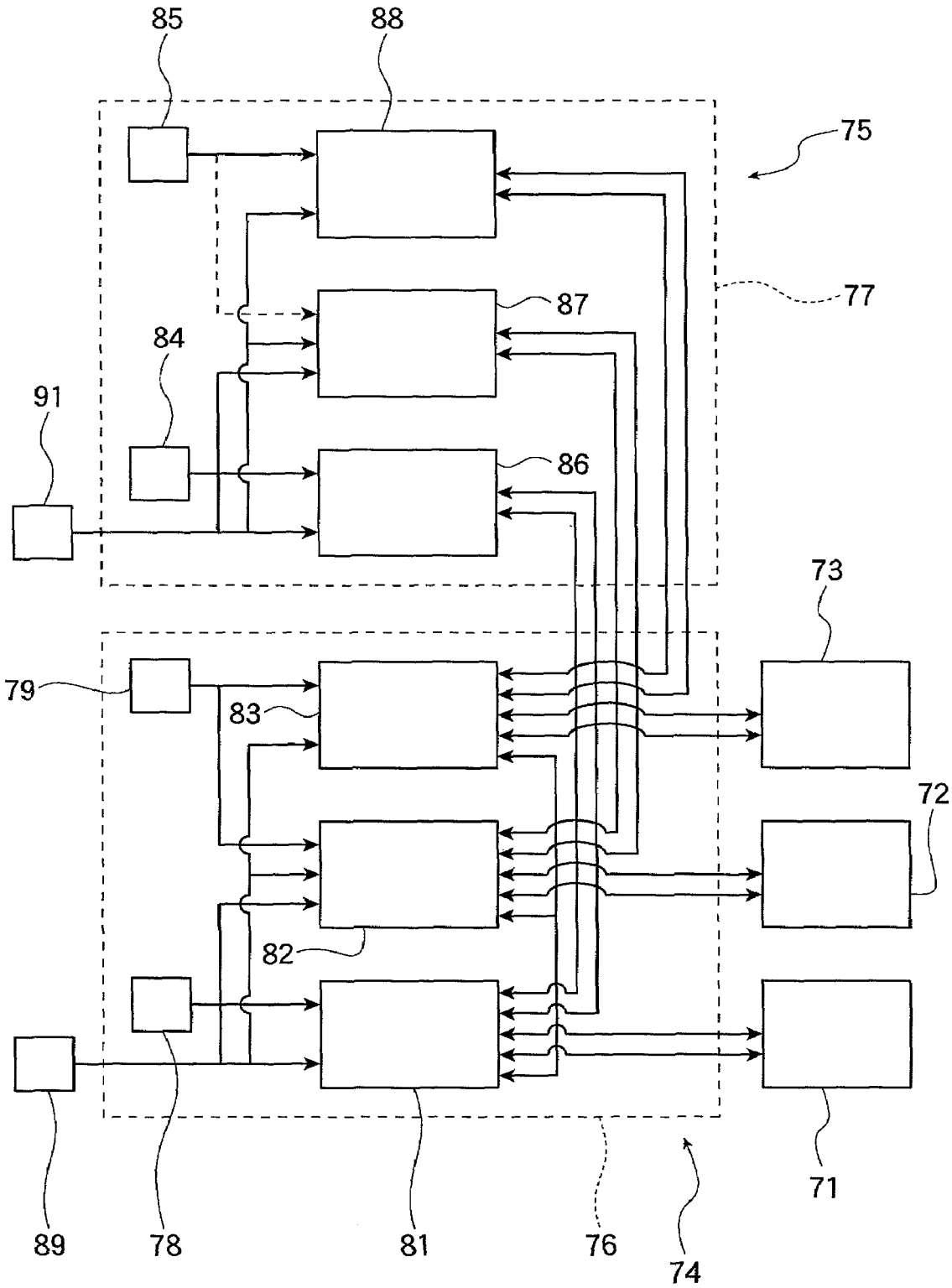

[FIG. 6]
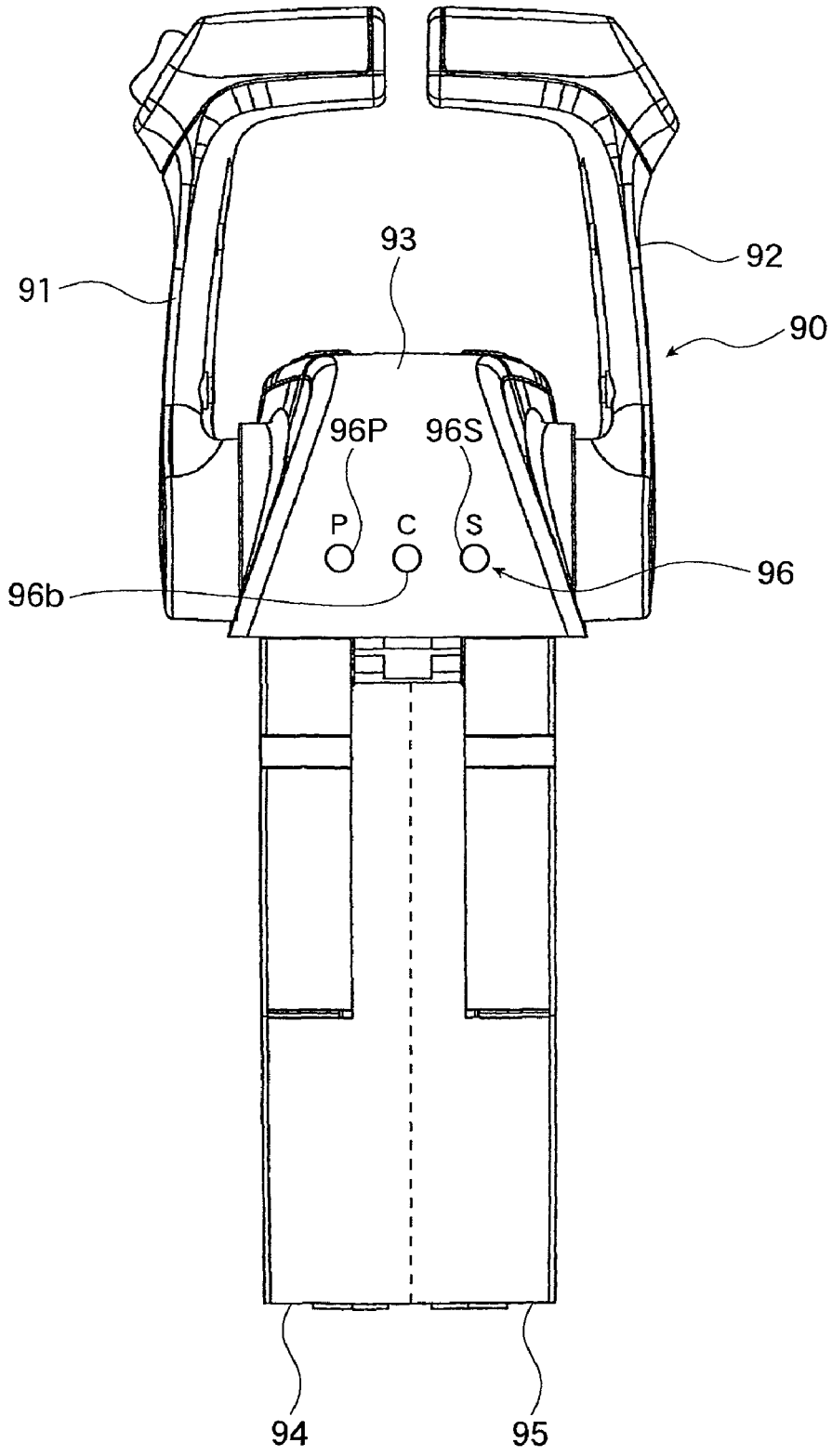

[FIG. 7]
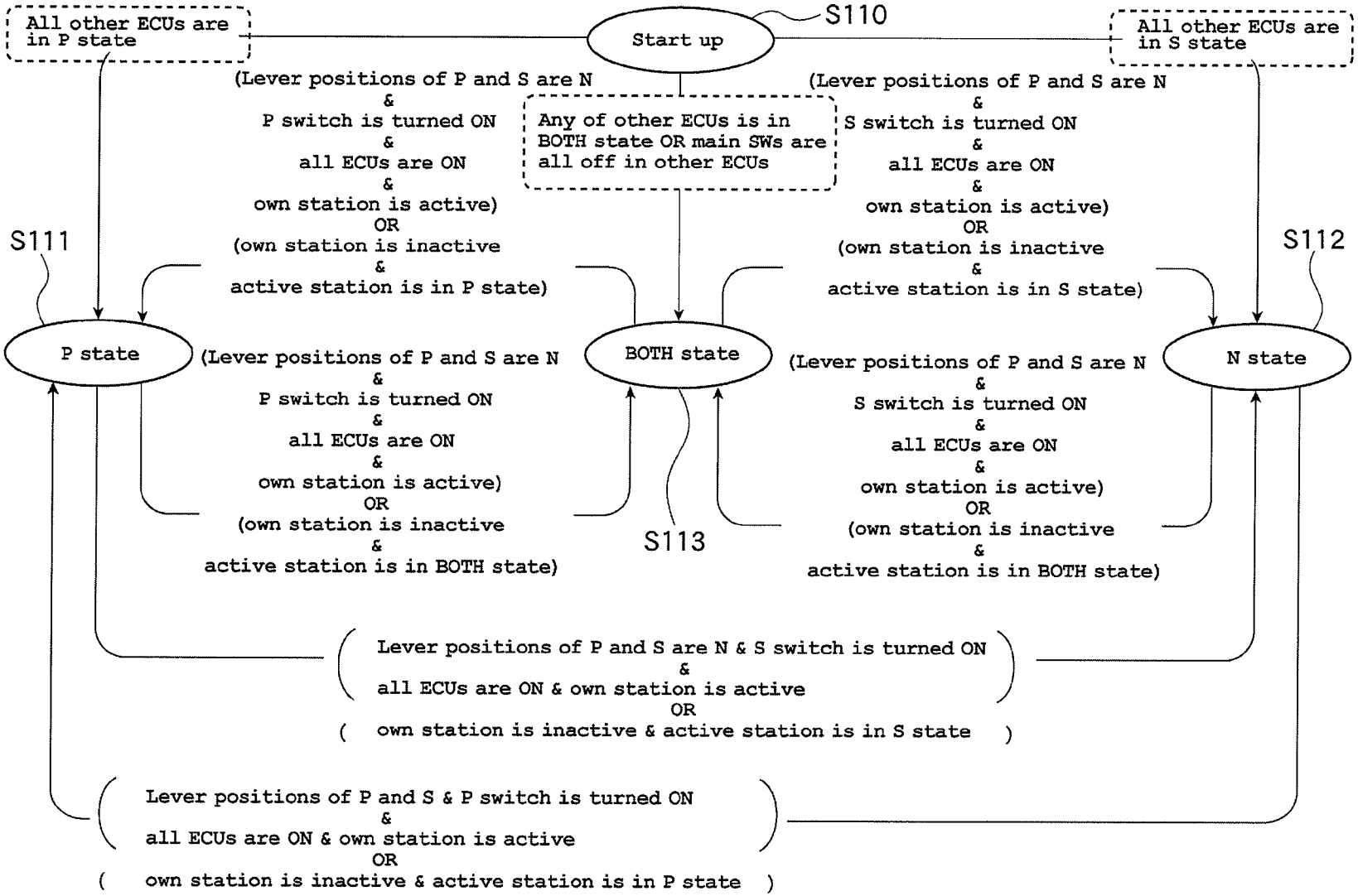

WATERCRAFT INCLUDING PLURAL OUTBOARD MOTORS AND CONTROL THEREOF

PRIORITY INFORMATION

This application is based on and claims priority to Japanese Patent Application No. 2006-206318, filed Jul. 28, 2006, the entire contents of which is hereby expressly incorporated by reference herein.

BACKGROUND OF THE INVENTION

1. Field of the Invention

The present invention relates to watercraft and, in particular, to a watercraft that has a plurality of propulsion units.

2. Description of the Related Art

Many watercrafts include outboard motors that are used as a watercraft propulsion unit. In such watercrafts, the outboard motors are typically disposed at the stern of the watercraft, a main station is disposed in the middle of a hull of the watercraft, and a substation is disposed above the main station.

Such watercraft can include a remote controller lever for operating the outboard motors on each steering station. In addition, one or each of the plural outboard motors can be operated by each station. These steering stations are configured such that they are selectively used depending on an arbitrary selection by an operator, and all the outboard motors can be controlled through lever operations at the selected steering station.

In certain cases, the remote controller lever is mechanically connected to the outboard motors by wires and the like. In such cases, operation of the lever of either steering station can causes the lever of the other station to be operated accordingly, and thus a plurality of the levers for operating the outboard motors can be constantly kept in the same operating state.

However, other watercraft use a remote controller in which displacement of a lever is transmitted to the control unit of the outboard motors as an operation signal. In such watercraft, each of a plurality of remote controller levers for operating the outboard motors can be operated independently, and thus an operating state, under which a displacement of either remote controller lever is different from a displacement of the other remote controller lever, tends to occur.

If the operating states of the plurality of the remote controller levers are different from one another, a problem can occur with steering when switching occurs between steering stations because the operation signals inputted to the outboard motors can change abruptly when the steering stations are switched. Thus, for example, Patent Document JP-B-3019984 describes a watercraft with a system for preventing abrupt changes in operation signal inputted to the outboard motors upon switching between the steering stations.

With watercrafts having a plurality of outboard motors, certain watercraft are configured such that the outboard motor that is operated can be selected using a selecting switch to operate the selected outboard motor with a remote controller lever. In such watercraft, the selecting switch is used for switching between the steering stations.

SUMMARY OF THE INVENTION

However, in the case of a watercraft with a plurality of outboard motors whose power supply system are independent from one another and controlling units are provided on each outboard motor to individually control a switching state of the steering stations and a selecting state of the outboard motors, each control unit starts controlling of the switching state of the steering stations and the selection state of the outboard motors from predetermined states when the outboard motors are started-up.

Therefore, when at least one of the outboard motors is in operation, the other outboard motor is started-up from a stop state after switching of the steering stations and selecting of the outboard motors are executed and their states have been changed from the predetermined states, the controlling unit of the outboard motor, which is started-up later, starts controlling from predetermined states. As a result, a circumstance occurs where a switching state of the steering stations and a selecting state of the outboard motors disagree between the controlling unit of the outboard motor that has been in operation and the controlling unit of the outboard motor which is started-up later.

In addition, in the event when the outboard motor that has been in operation momentarily stops and restarts due to unpredicted causes, so-called a sag, a circumstance occurs where the controlling states differ between the controlling unit of the outboard motor kept in operation and the controlling unit of the outboard motor that had a sag.

If such a difference in controlling states occurs, problems occur such as sudden changes in the steering station and remote controller lever of the at least one of outboard motors and sudden changes in controlling state of the outboard motors by at least one of the remote controller levers.

To solve such problems, the objective of the present invention is to provide a watercraft such that a controlling state of a watercraft propulsion unit before a start-up changes more smoothly and an operating state of a remote controller and a remote controller lever for operating the watercraft propulsion unit is more easily kept stable, although at least one of the watercraft propulsion units has been in operation and other watercraft propulsion units starts-up.

In order to solve the problems mentioned above, one aspect of the present invention provides a watercraft comprising: a plurality of watercraft propulsion units whose power supply systems are independent from one another; and remote controllers connected to the watercraft propulsion units, the remote controller including a plurality of controlling units corresponding to the watercraft propulsion units and remote controller levers for inputting a displacement to the controlling units, in which the controlling units are connected to communicate with one another; and when at least one of the watercraft propulsion units is in operation and other watercraft propulsion units start-up from a stop state, a controlling unit corresponding to the start-up watercraft propulsion unit recognizes a controlling state of the controlling unit corresponding to the at least one of the watercraft propulsion units and controls the start-up watercraft propulsion unit to agree with the controlling state thereof.

Another aspect of the present invention provides a watercraft further comprising a plurality of stations, the stations being provided with the remote controllers, in which the controlling state comprises a switching state from one station to the other station.

Still another aspect of the present invention provides a watercraft in which the remote controllers include a selecting switch for selecting which of the watercraft propulsion units to use, and the controlling state comprises a selecting state of the selecting switch.

Still another aspect of the present invention provides a watercraft in which when the controlling state is not transmitted to the controlling units corresponding to the start-up watercraft propulsion units from the other controlling units, or when a plurality of the different controlling states are transmitted, controlling is made such that the controlling units are all in a predetermined standard state.

In an aspect of the present invention, the power supply systems of the plurality of the watercraft propulsion units are independent from one another, the controlling unit is connected to each watercraft propulsion unit, and a switching state of the steering stations and a selecting state of the outboard motors are controlled on each controlling unit. Thus, each watercraft propulsion unit is individually started-up and controlled. However, in the case that at least one of the watercraft propulsion units has been in operation and other watercraft propulsion units starts-up from a stop state, the controlling unit corresponding to the other start-up watercraft propulsion units recognize a controlling state of the watercraft propulsion units in operation, which is transmitted by communication, and controls the other start-up watercraft propulsion units to agree with the controlling state, and thus a controlling state of the entire system can be kept stable although some of the watercraft propulsion units starts-up.

Therefore, in the event that at least one of the watercraft propulsion units starts-up from a stop state, or at least one of the watercraft propulsion units in operation has a sag and resetting due to unpredicted causes, operating states of the remote controllers and remote controller levers for operating the watercraft propulsion units remain unchanged, thus facilitating improvement of operability.

In another aspect of the invention, the controlling state of the controlling units corresponding to the start-up watercraft propulsion units, which agrees with the controlling state of the watercraft propulsion units in operation, comprises the switching state of the stations. Thus, in the event that some of the watercraft propulsion units start-up from a stop state or have a sag, changes in the steering station of the at least one of the watercraft propulsion units can be prevented.

In still another aspect of the invention, the controlling state of the controlling units corresponding to the start-up watercraft propulsion units, which agrees with the controlling state of the watercraft propulsion units in operation, comprises the selecting state of the selecting switches. Thus, in the event that some of the watercraft propulsion units start-up from a stop state or have a sag, changes in operating state of at least one of the remote controller levers can be prevented.

In still another aspect of the invention, when the controlling state is not transmitted to the controlling units corresponding to the start-up watercraft propulsion units from the other controlling units, or when a plurality of different controlling states are transmitted, controlling is performed so that all the controlling units are in a predetermined standard state. Therefore, although all the watercraft propulsion units start-up from a stop state or start-up when there is a time lag between when switching of the steering stations and selecting of the outboard motors are controlled, a switching process is normally performed and the entire system can be kept in a stable condition.

BRIEF DESCRIPTION OF THE DRAWINGS

FIG. 1 is a perspective rear view of a watercraft according to a first embodiment.

FIG. 2 is a schematic diagram of the connections between remote controllers, outboard motors and associated components of the watercraft of FIG. 1.

FIG. 3 is a block diagram showing the connections between the remote controllers, key switches, the outboard motors and other components of the watercraft of FIG. 1.

FIG. 4 is system flow diagram of a switching process of a remote controller switching determination processing section of the watercraft of FIG. 1.

FIG. 5 is a schematic diagram showing the connections of remote controllers and outboard motors of a watercraft according to a second embodiment.

FIG. 6 is a front view of a remote controller of a watercraft of a third embodiment.

FIG. 7 is a system flow diagram showing a switching process of a lever selection control section of the third embodiment.

DETAILED DESCRIPTION OF EMBODIMENTS

A first embodiment of a watercraft 10 is illustrated in FIGS. 1 through 4. With initial reference to FIGS. 1 and 2, the watercraft 10 includes two outboard motors 11 and 12 (or "watercraft propulsion units") whose power supply systems can be independent from one another. The outboard motors 11, 12 can be provided on a stern of a hull 10, and two cockpits including a main station 14 and a substation 15 can be provided on the hull 10. A main station side remote controller 17, a key switch device 18, and a steering wheel unit 19 are disposed in the main station 14. A substation side remote controller 21, a key switch device 22, and a steering wheel unit 23 can be disposed in the substation 15.

As shown in FIG. 3, in the main station side remote controller 17, a main station remote controller side ECU 27 for left unit as a "controlling unit" for the outboard motor 11 on the left side and a main station remote controller side ECU 28 for right unit as a "controlling unit" for the outboard motor 12 on the right side can be housed in a remote controller main body 26 and operatively connected together. Also, a pair of remote controller levers 29 and 30 can be configured to make throttle and shift operations corresponding to each of the outboard motors 11 and 12 are provided, and position sensors 31 and 32 can be configured to detect a position of each of the remote controller levers 29 and 30 are provided. The position sensors 31 and 32 can be operatively connected to the respective main station remote controller side ECUs 27 and 28 individually via two signal circuits b.

The main station remote controller side ECU 27 for left unit and the main station remote controller side ECU 28 for right unit can be configured such that process steps for alternatively switching between the main station side remote controller 17 and the substation side remote controller 21 are incorporated, and a remote controller switching control section for performing a switching process between the main station side remote controller 17 and the substation side remote controller 21 is included in each of the main station remote controller side ECUs 27 and 28.

Power trim and tilt (PTT) switches 33 and 34 can be operatively connected to the respective main station remote controller side ECUs 27 and 28 via a signal circuit.

A key switch device 18 is connected to the main station remote controller side ECUs 27 and 28 for the left and right units. In the key switch device 18, main switches 37 and 38, start switches 39 and 40, stop switches 41 and 42, and buzzers 43 and 44 respectively corresponding to the main station remote controller side ECUs 27 and 28 can be provided. In addition, in the key switch device 18, a main station changeover switch 45 comprising pushbuttons and so forth operated for making the main station side remote controller 17 available to function for the outboard motors 11 and 12 is provided. These can be operatively connected to the main station remote controller side ECUs 27 and 28 via the signal circuit b.

A steering wheel 46 can be provided on the steering wheel unit 19 of the main station 14, and, though not shown in the drawings, a rotating position (rotating angle position) of the steering wheel 46 can be detected by the position sensor and transmitted to a built-in steering wheel side ECU.

The steering wheel side ECU can be operatively connected to both the main station remote controller side ECUs 27 and 28 via DBWCAN cables as a signal line. Here, DBW is an abbreviation for Drive-By-Wire and can be an operation device for converting mechanical connection into electrical connection, and CAN is an abbreviation for Controller Area Network.

Meanwhile, in the substation side remote controller 21 of the substation 15, a substation remote controller side ECU 49 for left unit of the outboard motor 11 and a substation remote controlling side ECU 50 for right unit of the outboard motor 12 can be housed in a remote controller main body 48. Also, a pair of remote controller levers 51 and 52 corresponding to the remote controller levers 29 and 30 of the main station side remote controller 17 of the main station 14 can be provided, and position sensors 53 and 54 for detecting a position of each of these remote controller levers 51 and 52 can be provided. The position sensors 53 and 54 can be operatively connected to the respective substation remote controller side ECUs 49 and 50 individually via two signal circuits b.

The substation remote controller side ECU 49 for left unit and substation remote controller side ECU 50 for right unit can be configured to transmit detection signals from the respective position sensors 53 and 54 entirely to the main station remote controller side ECU 27 for left unit and the main station remote controller side ECU 28 for right unit of the main station side remote controller 17. The substation remote controller side ECU 49 for left unit and substation remote controller side ECU 50 for right unit do not include, in the illustrated embodiment, a remote controller switching control section for performing a switching process between the main station side remote controller 17 and the substation side remote controller 21 as mentioned above.

PTT switches 55 and 56 can be operatively connected to the respective substation remote controller side ECUs 49 and 50 via a signal circuit.

The key switch device 22 can be operatively connected to the substation remote controller side ECUs 49 and 50 for the left and right units. In this key switch device 22, start switches 59 and 60, stop switches 61 and 62, and buzzers 63 and 64 respectively corresponding to the substation remote controller side ECUs 49 and 50 can be provided. In addition, in this key switch device 22, a substation changeover switch 65 comprising pushbuttons operated for making the substation side remote controller 21 available to function for the outboard motors 11 and 12 can be provided. These devices can be operatively connected to the substation remote controller side ECUs 49 and 50 via the signal circuit b.

A steering wheel 66 cam be provided on the steering wheel unit 23 of the substation 15 and, though not shown in the drawings, a rotating position (rotating angle position) of the steering wheel 66 can be detected by a position sensor and transmitted to a built-in steering wheel side ECU.

In the main station side and substation side remote controllers 17 and 21, both the main station remote controller side ECUs 27 and 28 can be operatively connected to both the substation remote controller side ECUs 49 and 50. That is, in the illustrated embodiment, the substation remote controller side ECU 49 for left unit can be operatively connected to the main station remote controller side ECU 27 for left unit via power supply cables f and DBWCAN cables e, and also the substation remote controller side ECU 50 for right unit can be operatively connected to the main station remote controller side ECU 28 for right unit via the power supply cables f and the DBWCAN cables e. In addition, the main station remote controller side ECU 27 for left unit and the main station remote controller side ECU 28 for right unit can be operatively connected together via a communication line between ECUs g.

The main station remote controller side ECU 27 for left unit can be operatively connected to the outboard motor 11 on the left side via the power supply cables f and the DBWCAN cables e and also the main station remote controller side ECU 28 for right unit can be operatively connected to the outboard motor 12 on the right side via the power supply cables f and the DBWCAN cables e. Three batteries 69 can be operatively connected to these outboard motors 11 and 12.

In each of the outboard motors 11 and 12, a fuel injection amount, injection timing, and ignition timing can be controlled by controlling signals sent via the power supply cables f and the DBWCAN cables e from each of the main station remote controller side ECUs 27 and 28 based on a throttle opening angle from a throttle opening angle sensor, an engine speed from a crank angle sensor, and detected values from each of other sensors.

The several detected values (driving information) such as a throttle opening angle and the engine speed can be sent from these outboard motors 11 and 12 to the respective main station remote controller side ECUs 27 and 28 via the DBWCAN cables e, and the driving information can be mutually transmitted between both the main station remote controller side ECUs 27 and 28 via the communication line between ECUs g.

In each of the main station remote controller side ECUs 27 and 28, controlling signals can be sent to each of the outboard motors 11 and 12, and a fuel injection amount, injection timing, ignition timing and so forth of each of the outboard motors 11 and 12 can be controlled so that a difference between the engine speeds stays in a targeted value using the driving information from each of the outboard motors 11 and 12 based on operation of either of the remote controller levers 29 and 30 of the main station side remote controller 17 or the remote controller levers 51 and 52 of the substation side remote controller 21 selected by the switching process in the remote controller switching control sections.

The remote controller switching control sections included in the main station remote controller side ECUs 27 and 28 of the watercraft can be configured, for example as shown in FIG. 4, such that a switching process for making the main station side remote controller 17 or the substation side remote controller 21 available can be performed.

To perform a switching from a main station controlling state S101 under which the main station side remote controller 17 is operative to a substation controlling state S103 under which the substation side remote controller 21 is operative or vice versa, first the remote controller levers 29 and 30 of the main station side remote controller 17 and the remote controller levers 51 and 52 of the substation side remote controller 21 are shifted to the neutral state, and the substation changeover switch 65 is turned ON.

Then, if the conditions are satisfied in the main station remote controller side ECUs 27 and 28 such that the remote controller levers 29 and 30 of the main station side remote controller 17 are in the neutral state, the remote controller levers 51 and 52 of the substation side remote controller 21 are in the neutral state, and the main station changeover switch 45 or the substation changeover switch 65 is turned to the ON state, the main station remote controller side ECUs 27 and 28 are in a determining state S102 or S104.

A determining period, for which the determining state S102 or S104 is sustained, is preset in each of the main station remote controller side ECUs 27 and 28. In the determining state S102 or S104, information transmitted from the other one of the main station remote controller side ECUs 27 and 28 through the communication between ECUs cam be determined in the determining period.

Here, because the main switches 37 and 38 corresponding to the main station remote controller side ECUs 27 and 28 are in the ON state, a switching process from the main station side remote controller 17 to the substation side remote controller 21 or vice versa can be performed in each of the main station remote controller side ECUs 27 and 28 if switching availability information indicating that the remote controller levers 29 and 30 of the main station side remote controller 17 and the remote controller levers 51 and 52 of the substation side remote controller 21 are in the neutral state is transmitted from the other one of the main station remote controller side ECUs 27 and 28 within the determining period.

In addition, if either one of the main switches 37 and 38 is in the OFF state, there is no information transmitted through the communication between ECUs, and a switching process from the main station side remote controller 17 to the substation side remote controller 21 or vice versa can be solely performed. In this embodiment, the switching process is also performed even if the other one of the main station remote controller side ECUs 27 and 28 has been already in the controlling state S101 or S103 after the switching process.

Meanwhile, in the determining state S102 or S104, no switching process can be performed, returning to the original controlling state S101 or S103 in the case that both the main switches 37 and 38 are in the ON state and switching availability information is not transmitted to each of the main station remote controller side ECUs 27 and 28 within the determining periods.

In such determining processes, for example, in the case that a switching process is performed to the different station controlling states S101 and S103 between both the main station remote controller side ECUs 27 and 28 due to a delay of the communication between ECUs, a switching process can be performed such that the one of the main station remote controller side ECU 27 and 28 in the substation controlling state S103 is compulsorily switched into the main station controlling state S101.

In the watercraft of the first embodiment, a start-up state S100, under which a predetermined switching process can be performed when each of the outboard motors 11 and 12 and the corresponding main station remote controller side ECUs 27 and 28 start-up, is set in the remote controller switching control section included in each of such main station remote controller side ECUs 27 and 28.

In the start-up state S100, in each of the main station remote controller side ECUs 27 and 28, a switching selection information of the other one of the main station remote controller side ECU 27 and 28 transmitted through the communication line between ECUs g is obtained and determined. The switching selection information is, for example, held in each of the main station remote controller side ECUs 27 and 28 corresponding to the outboard motors 11 and 12 in operation. This information is used to recognize if the main station remote controller side ECU 27 or 28 is in the main station controlling state S101 or the substation controlling state S103, or the determining state S102 or S104.

Here, in the case that the main station remote controller side ECUs 27 and 28 corresponding to the outboard motors 11 and 12 in operation are in the main station controlling state S101, a switching process is executed such that the main station remote controller side ECUs 27 and 28 corresponding to the start-up outboard motors 11 and 12 are switched to the main station controlling state S101.

Meanwhile, in the case that the main station remote controller side ECUs 27 and 28 corresponding to the outboard motors 11 and 12 in operation are in the substation controlling state S103, a switching process is executed such that the main station remote controller sides ECU 27 and 28 corresponding to the start-up outboard motors 11 and 12 are switched to the substation controlling state S103.

In each of the main station remote controller side ECUs 27 and 28, a remote controller switching standard state is preset so that the main switching state S101 is selected. Therefore, on starting, in the case that there is no other outboard motor 11 or 12, and main station remote controller side ECU 27 or 28 in operation, that is, all the outboard motors 11 and 12, and the main station remote controller side ECUs 27 and 28 are started-up from a stop state, a switching process is executed such that the main station remote controller side ECUs 27 and 28 corresponding to the start-up outboard motors 11 and 12 are switched to the main station controlling state S101.

The aforementioned switching control flow can be followed after the switching process is performed from the start-up state S100 to the main station controlling state S101 or the substation controlling state S103.

With the watercraft described above, the power supply systems of the plurality of the outboard motors 11 and 12 are independent from one another, and the remote controller switching control sections of the main station remote controller side ECUs 27 and 28 for performing switching processes of the remote controllers 17 and 21 for operating each of the outboard motors 11 and 12 are provided corresponding to each of the outboard motors 11 and 12. This allows the outboard motors to be individually started-up and controlled. In this case, if either one of the outboard motors 11 and 12 has been in operation and the other starts-up, the remote controller switching control section corresponding to the start-up one of the outboard motors 11 and 12 obtains and recognizes a switching selection information of the remote controller switching control section of the other outboard motor 11 or 12 in operation, which is transmitted through the communication line between ECUs g, and a switching process is executed based on the switching selection information. Thus, the switching state of the start-up one of the remote controllers 17 and 21 agrees with the switching state of the other one of the remote controllers 17 and 21 in operation, so that the switching state of the entire system can be kept stable.

Therefore, in the event that the outboard motors 11 and 12, which have partly stopped, start, or the outboard motors 11 and 12 in operation have a sag and resetting due to unpredicted causes, operating states of at least one of the remote controller levers 29, 30, 51, and 52 of the remote controllers 17 and 21 remain unchanged, thus facilitating improvement of operability.

Moreover, the main station side remote controller 17 can be connected to each of the outboard motors 11 and 12, while the substation side remote controller 21 can be connected to the main station side remote controller 17. Also, the main station remote controller side ECUs 27 and 28 corresponding to the outboard motors 11 and 12 can be provided in the main station side remote controller 17. Thus, although a plurality of the remote controllers 17 and 21 for operating the same outboard motors 11 and 12 are provided, the numbers of the remote controller switching control sections and of the communication line between ECUs g are kept smaller, thereby easily attaining a simple configuration.

The remote controller switching standard state for selecting the main station side remote controller 17 is preset in the remote controller switching control section. Thus, a switching process to compulsorily make the main station remote controller 17 available can be executed, when switching selection information is not transmitted from one of the main station remote controller side ECUs 27 and 28 to the other main station remote controller side ECU 27 or 28 of the start-up outboard motor 11 or 12. For example, in the case that all the outboard motors 11 and 12 start from a stop state, a switching process can be normally performed, and the entire system can be kept in a stable condition.

FIG. 5 shows a schematic illustration of the connection between remote controllers and outboard motors of a watercraft of a second embodiment.

The watercraft can include three outboard motors 71, 72, and 73, and is configured so that these outboard motors 71, 72 and 73 can be operated by a main station side remote controller 76 and a substation side remote controller 77 respectively provided on a main station 74 and a substation 75.

A pair of remote controller levers 78 and 79 can be provided on the main station side remote controller 76, while three main station remote controller side ECUs 81, 82 and 83 corresponding to the three outboard motors 71, 72 and 73 can be provided through a direct connection to the respective outboard motors. A position sensor of the remote controller lever 78 can be operatively connected to the main station remote controller side ECUs 81 and 82 and also a position sensor of the remote controller lever 79 can be connected to the main station remote controller side ECUs 82 and 83. The main station remote controller side ECUs 81, 82 and 83 can be connected to the corresponding outboard motors 71, 72 and 73.

Meanwhile, in the substation side remote controller 77, a pair of remote controller levers 84 and 85 are provided, while three substation remote controller side ECUs 86, 87 and 88 corresponding to the three main station remote controller side ECUs 81, 82 and 83 can be provided. A position sensor of the remote controller lever 84 is connected to the substation remote controller side ECUs 86 and 87, and also a position sensor of the remote controller lever 85 is connected to the substation remote controller side ECUs 87 and 88. The substation remote controller side ECUs 86, 87 and 88 are connected to the corresponding main station remote controller side ECUs 81, 82 and 83. Operations of a pair of the remote controller levers 84 and 85 can be transmitted to the main station remote controller side ECUs 81, 82 and 83 to control the three outboard motors 71, 72 and 73.

In key switch devices of the main station 74 and the substation 75, a main station changeover switch 89 and a substation changeover switch 97 can be provided, respectively, and connected to the main station remote controller side ECUs 81, 82 and 83 and the substation remote controller side ECUs 86, 87 and 88.

In the second embodiment also, each of the main station remote controller side ECUs 81, 82 and 83 can be configured to include a remote controller switching control section for performing a switching process for making the main station side remote controller 76 or the substation side remote controller 77 available, and also the main station remote controller side ECUs 81, 82 and 83 are connected together by ECU communication lines to communicate with each other.

In the remote controller switching control section of each of the main station remote controller side ECUs 81, 82 and 83, a start-up state S100 is set such that a switching process is performed when each of the outboard motors 71, 72 and 73 starts. In the start-up state S100, switching selection information of the other one of the main station remote controller side ECUs 81, 82 and 83, which is transmitted via a communication line between ECUs g, is obtained to execute a switching process.

Here, the main station remote controller side ECU 81, 82, 83 corresponding to the start-up outboard motor 71, 72, 73 executes switching processes such that the main station remote controller side ECU 81, 82, 83 corresponding to the start-up outboard motor 71, 72, 73 is switched to a main station controlling state S101, if the main station remote controller side ECUs 81, 82, 83 corresponding to the other outboard motors 71, 72, 73 in operation are in the main station controlling state S101.

Meanwhile, if the main station remote controller side ECUs 81, 82, 83 corresponding to the other outboard motors 71, 72, 73 in operation are in a substation controlling state S103, a switching process is executed such that the main station remote controller side ECU 81, 82, 83 corresponding to the start-up outboard motor 71, 72, 73 is switched to the substation controlling state S103.

A remote controller switching standard state for selecting the main station switching state S101 is preset in each of the main station remote controller side ECUs 81, 82 and 83. Therefore, on starting, if there is no other outboard motors 71, 72 or 73 and the main station remote controller side ECUs 81, 82 or 83 in operation, that is, if all the outboard motors 71, 72 and 73 and the main station remote controller side ECUs 81, 82 and 83 start from a stop state, a switching process is executed such that the main station remote controller side ECUs 81, 82 and 83 corresponding to the start-up outboard motors 71, 72 and 73 are switched to the main station controlling state S101.

Also if different switching selection information is transmitted to the main station remote controller side ECU 81, 82 or 83 of the one start-up outboard motor 71, 72 or 73 from the main station remote controller side ECU 81, 82 and/or 83 of the other two outboards motors 71, 72 and/or 73, a switching process to compulsorily select the main station side remote controller 76 can be similarly executed. Thus, a switching process can be normally performed in a peculiar situation where the outboard motor starts in a period for which a plurality of the remote controller switching control sections individually perform a switching process.

Effects similar to the first embodiment can also be realized with the watercraft of the second embodiment described above.

FIGS. 6 and 7 show a third embodiment. Here, similar to the first and second embodiments, a plurality of steering stations are provided, and a remote controller is provided in each steering station.

As shown in FIG. 6, a pair of remote controller levers 91 and 92 are provided on a remote controller 90, two remote controller side ECUs 94 and 95 corresponding to the two outboard motors 11 and 12 are provided in a remote controller body 93, and a lever selecting switch 96 for selecting which of the outboard motors 11 and 12 to use can be provided.

The lever selecting switch 96 includes: a P state controlling switch 96*p* for selecting the P state under which the outboard motor 11 disposed on the left side is operated according to a displacement of the remote controller lever 91, while the remote controller lever 92 is constantly kept in the neutral state regardless of the displacement; an S state controlling switch 96*s* for selecting the S state under which the outboard motor 12 disposed on the right side is operated according to a displacement of the remote controller lever 92, while the remote controller lever 91 is constantly kept in the neutral state regardless of the displacement; a BOTH state controlling switch 96*b* for selecting the BOTH state under which the outboard motor 11 disposed on the left side is operated according to a displacement of the remote controller lever 91, while the outboard motor 12 disposed on the right side is operated according to the displacement of the remote controller lever 92.

In each of the remote controller side ECUs 94 and 95, a lever selection control section is provided so that the outboard motors 11 and/or 12 with the respective remote controller levers 91 and/or 92 are selected according to these lever selecting switches 96 and correspondence between the remote controller levers 91 and 92 and the respective remote controller side ECUs 94 and 95 can be controlled. In the third embodiment, each of the remote controller side ECUs 94 and 95 of the remote controller 90 disposed in the main station 14 includes the lever selection control section, and the remote controller side ECUs 94 and 95 disposed in the main station 14 are connected by the communication line between ECUs g.

The configuration can be the same as in the first embodiment, except the description above.

The lever selection control section included in the remote controller side ECUs 94 and 95 of such a watercraft is configured so that switching processes shown in FIG. 7 can be performed.

Here, the P state S111, the S state S112, or the BOTH state S113 is mutually selectable under a predetermined condition. That is, a selecting process can be performed when all the outboard motors 11 and 12 and the remote controller ECUs are in the ON state, the remote controller levers 91 and 92 are in the neutral state, and any one of the switches are turned into the ON state among the P state controlling switch 96*p*, the S state controlling switch 96*s*, and the BOTH state controlling switch 96*b* of the remote controller 90 of the station where operation of the outboard motors 11 and 12 is available.

In another embodiment, in the lever selection control section included in each of the remote controller side ECUs 94 and 95, a start-up state S110 is set such that a selecting process can be performed when each of the outboard motors 11 and 12 and the corresponding main station remote controller side ECUs 27 and 28 start.

In the start-up state S110, in each of the remote controller side ECUs 94 and 95, selecting information of the other remote controller side ECU 94 or 95 transmitted via the communication line between ECUs g is obtained and determined. The selecting information is, for example, held in each of the remote controller side ECUs 94 and 95 corresponding to the outboard motors 11 and 12 in operation. This information can be used to recognize if the remote controller side ECU 94 or 95 is in the P state S111, the S state S112, or the BOTH state S113.

Here, the remote controller side ECU 94 or 95 corresponding to the start-up outboard motor 11 or 12 executes a selecting process to agree with the state of the remote controller side ECU 94 or 95 corresponding to the other outboard motor 11 or 12 in operation, that is, the state S111, S112, or the BOTH state 113.

In addition, in each of the remote controller side ECUs 94 and 95, the BOTH state S113 is preset as the lever selecting standard state under which all the outboard motors 11 and 12 are operated by all the remote controller levers 91 and 92 of the same remote controller 90. Therefore, on starting, if there is no other outboard motor 11 or 12 in operation, and the remote controller side ECU 94 or 95, that is, if all the outboard motors 11 and 12 and the remote controller side ECUs 94 and 95 are started-up from a stop state, a selecting process is executed to select the BOTH state S113 of the remote controller side ECUs 94 and 95 corresponding to the start-up outboard motors 11 and 12.

With a watercraft described above, the power supply systems of a plurality of the outboard motors 11 and 12 are independent from one another, and the lever selection control sections of the remote controller side ECUs 94 and 95 for performing switching processes of the remote controller levers 91 and 92 for operating each of the outboard motors 11 and 12 are provided corresponding to each of the outboard motors 11 and 12. Thus, when either one of the outboard motors 11 or 12 has been in operation and the other starts, the lever selection control section corresponding to the start-up outboard motor 11 or 12 obtains the selecting information of the lever selecting control section of the other outboard motor 11 or 12 in operation, which is transmitted via the communication line between ECUs g, and executes a selecting process. Therefore, the selecting state of the remote controller lever 91 or 92 before starting is difficult to change and the switching state of the entire system can be kept stable.

Therefore, in the event that one of the outboard motors 11 and 12 starts from a stop state, and the other one of the outboard motors 11 and 12 in operation has a sag and resetting due to unpredicted causes, when the one of the outboard motors 11 and 12 and the remote controller side ECUs 94 and 95 start, shifting of the remote controller levers for operating the other one of the outboard motors 11 and 12 in operation are prevented and changes in operating state of the other one of the outboard motors 11 and 12 can be prevented.

Also in the event that selecting information is not transmitted to the lever selecting control section of the remote controller side ECU 94 or 95 of the start-up outboard motor 11 or 12 from the other lever selection control section, a selecting process is executed such that the lever selection control section of the remote controller side ECU 94 or 95 corresponding to the start-up outboard motor 11 or 12 can be turned to the BOTH state S113. Therefore, a selecting process can be normally performed even if all the outboard motors 11 and 12 are started-up from a stop state, and the entire system can be kept is a stable condition.

In the third embodiment, an example of the boat having two outboard motors 11 and 12 is described. However, the watercraft can include three or more outboard motors. In that case, if different kinds of selecting information are transmitted from a plurality of outboard motors and the remote controller side ECUs 94 and 95 due to starting of one of the outboard motors and the remote controller side ECUs 94 and 95 in a period for performing selecting processes in a plurality of the lever selection control sections, a switching process can be executed such that the remote controller side ECUs 94 and 95 corresponding to the start-up outboard motors are switched to the BOTH state S113, or a switching process can be performed by obtaining selecting information of the lever selection control section corresponding to the outboard motor disposed in the middle.

It should be noted that the lever selection control section described above may be provided together with a remote controller switching determination processing section for performing a switching process between a plurality of remote controllers as in the first embodiment.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A watercraft comprising:

a plurality of watercraft propulsion units; and a plurality of remote controllers each connected to the plurality of watercraft propulsion units, each remote controller including a controlling unit corresponding to each of the plurality of watercraft propulsion units and remote controller levers arranged to input a displacement to the controlling units, the controlling units being operatively connected each other; and a plurality of stations on the watercraft, each of the plurality of stations being provided with one of the plurality of remote controllers; wherein the controlling units are programmed such that when at least one of the watercraft propulsion units is in operation and one or more watercraft propulsion units starts-up from a stop state, the controlling unit corresponding to the one or more started-up watercraft propulsion units recognizes a controlling state of the controlling unit corresponding to the at least one of the operating watercraft propulsion units and controls the one or more started-up watercraft propulsion units to agree with the controlling state of the at least one of the operating watercraft propulsion units; and the controlling state includes a switching state for using the remote controller in a first station and using the remote controller in a second station such that the controlling unit corresponding to the one or more started-up watercraft propulsion units recognizes the switching state of the controlling unit corresponding to the at least one of the operating watercraft propulsion units.

2. The watercraft according to claim 1, wherein the controlling units are programmed such that, when the controlling state is not transmitted to the controlling unit corresponding to the one or more started-up watercraft propulsion units from the controlling unit corresponding to the at least one of the operating watercraft propulsion units, or when a plurality of the different controlling states are transmitted, a control is made such that the controlling units are in a predetermined standard state.

3. The watercraft according to claim 1, wherein the remote controllers include a lever selecting switch arranged to switch a watercraft propulsion unit to use, and wherein the controlling state includes a selecting state of the lever selecting switch.

4. The watercraft according to claim 3, wherein when the controlling state is not transmitted to the controlling unit corresponding to the one or more started-up watercraft propulsion units from the controlling unit corresponding to the at least one of the operating watercraft propulsion units, or when a plurality of the different controlling states are transmitted, a control is made such that the controlling units are in a predetermined standard state.

5. A method of operating a watercraft that includes a plurality of watercraft propulsion units, the method comprising the steps of:

starting UP one or more of the watercraft propulsion units from a stop state when at least one of the watercraft propulsion units is operating;

recognizing, with a controlling unit corresponding to the one or more started-up watercraft propulsion units, a controlling state of a controlling unit corresponding to the at least one of the operating watercraft propulsion units; and controlling the one or more started-up watercraft propulsion units to agree with the controlling state of the at least one of the operating watercraft propulsion units; wherein the controlling state includes a selecting state of a selecting switch for using a remote controller in a first station and using a remote controller in a second station such that the controlling unit corresponding to the one or more started-up watercraft propulsion units recognizes the selecting state of the controlling unit corresponding to the at least one of the operating watercraft propulsion units.

6. The method according to claim 5, further comprising controlling the controlling units such that they are in a predetermined standard state when the controlling state is not transmitted to the controlling unit corresponding to the one or more started-up watercraft propulsion units from the controlling unit corresponding to the at least one of the operating watercraft propulsion units, or when a plurality of the different controlling states are transmitted.

7. The method according to claim 5, further comprising selecting a watercraft propulsion unit to use with a lever selecting switch and wherein the controlling state includes a selecting state of the lever selecting switch.

8. The method according to claim 7, further comprising controlling the controlling units such that they are in the predetermined standard state when the controlling state is not transmitted to the controlling unit corresponding to the one or more started-up watercraft propulsion units from the controlling unit of the at least one of the operating watercraft propulsion units, or when a plurality of different controlling states are transmitted.

9. A watercraft comprising:

a plurality of watercraft propulsion units;

a plurality of remote controllers each connected to the plurality of watercraft propulsion units, each remote controller including a controlling unit corresponding to each of the plurality of watercraft propulsion units and remote controller levers arranged to input a displacement to the controlling units, the controlling units being operatively connected each other;

an operating device arranged to operate the watercraft propulsion units such that when at least one of the watercraft propulsion units is in operation and one or more watercraft propulsion units starts-up from a stop state, the controlling unit corresponding to the one or more started-up watercraft propulsion units recognizes a controlling state of the controlling unit corresponding to the at least one of the operating watercraft propulsion units and controls the one or more started-up watercraft propulsion unit to agree with the controlling state of the at least one of the operating watercraft propulsion units; and a plurality of stations, each of the plurality of stations being provided with one of the plurality of remote controllers; wherein the controlling state includes a switching state for using the remote controller in a first station and using the remote controller in a second station such that the controlling unit corresponding to the one or more started-up watercraft propulsion units recognizes the switching state of the controlling unit corresponding to the at least one of the operating watercraft propulsion units.

10. The watercraft according to claim 9, wherein the control units are programmed such that, when the controlling state is not transmitted to the controlling unit corresponding to the one or more started-up watercraft propulsion units from the controlling unit corresponding to the at least one of the operating watercraft propulsion units, or when a plurality of the different controlling states are transmitted, a control is made such that the controlling units are in a predetermined standard state.

11. The watercraft according to claim 9, wherein the remote controllers comprise a lever selecting switch arranged to select a watercraft propulsion unit to use, and wherein the controlling state includes a selecting state of the lever selecting switch.

* * * * *